US010095138B2

(12) United States Patent
Narita et al.

(10) Patent No.: US 10,095,138 B2
(45) Date of Patent: Oct. 9, 2018

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Kosuke Narita, Kanagawa (JP); Taketoshi Hoshizaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,981

(22) Filed: Sep. 8, 2017

(65) Prior Publication Data

US 2018/0210356 A1 Jul. 26, 2018

(30) Foreign Application Priority Data

Jan. 23, 2017 (JP) ..... 2017-009127

(51) Int. Cl.

| | |
|---|---|
| ***G03G 5/00*** | (2006.01) |
| ***G03G 5/14*** | (2006.01) |
| ***G03G 15/00*** | (2006.01) |
| ***G03G 5/047*** | (2006.01) |
| ***G03G 5/05*** | (2006.01) |
| ***G03G 5/06*** | (2006.01) |
| ***G03G 5/02*** | (2006.01) |

(52) U.S. Cl.

CPC ..... *G03G 5/144* (2013.01); *G03G 5/02* (2013.01); *G03G 5/047* (2013.01); *G03G 5/0539* (2013.01); *G03G 5/0542* (2013.01); *G03G 5/0614* (2013.01); *G03G 5/0696* (2013.01); *G03G 15/75* (2013.01)

(58) Field of Classification Search

CPC ..... G03G 5/02; G03G 5/047; G03G 5/144
USPC ..... 430/56, 60
See application file for complete search history.

(56) References Cited

U.S. PATENT DOCUMENTS

| | | | |
|---|---|---|---|
| 5,298,617 | A | 3/1994 | Nukada et al. |
| 5,302,479 | A | 4/1994 | Daimon et al. |
| 5,459,004 | A | 10/1995 | Katsumi et al. |
| 5,637,142 | A | 6/1997 | Kubo et al. |
| 9,625,838 | B2 | 4/2017 | Sugiyama et al. |

FOREIGN PATENT DOCUMENTS

| | | | |
|---|---|---|---|
| EP | 0 710 893 | A1 | 5/1996 |
| JP | 04-189873 | A | 7/1992 |
| JP | 5-098181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 8-176293 | A | 7/1996 |
| JP | 8-208820 | A | 8/1996 |

(Continued)

*Primary Examiner* — Mark A Chapman
(74) *Attorney, Agent, or Firm* — Sughrue Mion, PLLC

(57) ABSTRACT

An electrophotographic photoreceptor includes a conductive substrate and a photosensitive layer disposed on the conductive substrate, wherein when time that takes for a current value to reach the maximum after beginning of application of a square wave voltage to the electrophotographic photoreceptor is $T_1$ and time that takes for the current value to reach the maximum after the beginning of the application of the square wave voltage and then decrease to one fifth of the maximum is $T_2$, $T_2$ is approximately from 3.2 to 11.0 times as large as $T_1$.

13 Claims, 4 Drawing Sheets

(56) References Cited

FOREIGN PATENT DOCUMENTS

| | | | |
|---|---|---|---|
| JP | 2004-078147 | A | 3/2004 |
| JP | 2005-181992 | A | 7/2005 |
| JP | 4251662 | B2 | 4/2009 |
| JP | 2012-155282 | A | 8/2012 |
| JP | 2014-153550 | A | 8/2014 |
| JP | 2016-110129 | A | 6/2016 |
| WO | 2008/053904 | A1 | 5/2008 |

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2017-009127 filed Jan. 23, 2017.

BACKGROUND

Technical Field

The present invention relates to an electrophotographic photoreceptor, a process cartridge, and an image forming apparatus.

SUMMARY

According to an aspect of the invention, there is provided an electrophotographic photoreceptor including a conductive substrate and a photosensitive layer disposed on the conductive substrate, wherein when time that takes for a current value to reach the maximum after beginning of application of a square wave voltage to the electrophotographic photoreceptor is $T_1$ and time that takes for the current value to reach the maximum after the beginning of the application of the square wave voltage and then decrease to one fifth of the maximum is $T_2$, $T_2$ is approximately from 3.2 to 11.0 times as large as $T_1$.

BRIEF DESCRIPTION OF THE DRAWINGS

Exemplary embodiments of the present invention will be described in detail based on the following figures, wherein.

DETAILED DESCRIPTION

Exemplary embodiments that are examples of the invention will now be described in detail.

Electrophotographic Photoreceptor

An electrophotographic photoreceptor according to a first exemplary embodiment (also referred to as "photoreceptor") includes a conductive substrate and a photosensitive layer disposed on the conductive substrate.

When the time that takes for a current value to reach the maximum after the beginning of application of a square wave voltage to the photoreceptor is $T_1$ and the time that takes for the current value to reach the maximum after the beginning of the application of the square wave voltage and then decrease to one fifth of the maximum is $T_2$, $T_2$ is approximately from 3.2 to 11.0 times as large as $T_1$.

The term "current value" herein refers to an electric current that flows in the thickness direction of the photoreceptor (namely, the thickness direction of layers including the photosensitive layer disposed on the conductive substrate) on application of a square wave voltage to the photoreceptor, and it is specifically measured as follows.

A conductive rubber electrode (specifically, conductive rubber, thickness: 1 mm, manufactured by KONAN G TECH CO., LTD) is attached to a photoreceptor to be subjected to the measurement, a square wave voltage (maximum: 300 V, pulse width: 10 μs) is applied to the photoreceptor with a ferroelectrics-evaluating system (manufactured by TOYO Corporation, Model 6252), and a temporal change in a current value after the beginning of the application is measured. Specifically, the square wave voltage is, for example, applied between the conductive rubber electrode as the positive electrode and the conductive substrate as the negative electrode.

Figure 1:
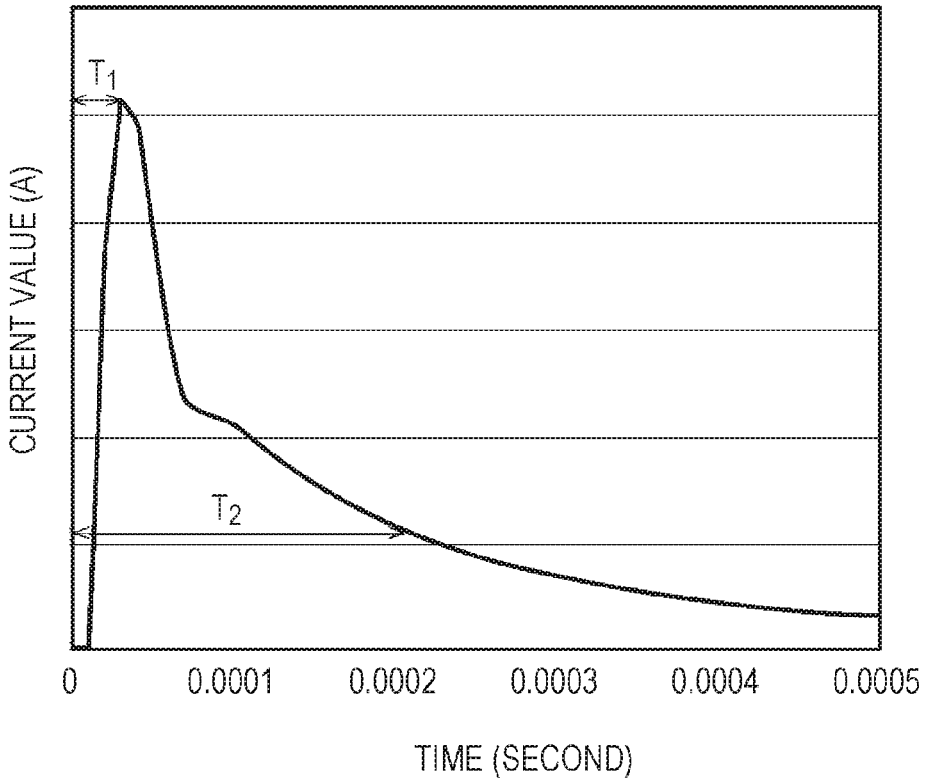
FIG. 1 illustrates an example of a temporal change in a current value after the beginning of application of a square wave voltage to an electrophotographic photoreceptor.

FIG. 1 illustrates an example of the temporal change in a current value after the beginning of application of a square wave voltage to the photoreceptor. As illustrated in FIG. 1, the application of a square wave voltage to the photoreceptor causes the current value to increase, and the current value reaches the maximum and then decrease. The time that takes for the current value to reach the maximum after the beginning of the application is defined as $T_1$, and the time that takes for the current value to reach the maximum after the beginning of the application and then decrease to one fifth of the maximum is defined as $T_2$.

$T_2$ is adjusted to be approximately from 3.2 to 11.0 times as large as $T_1$, so that the occurrence of fine colored lines is reduced when the photoreceptor is used in an image forming apparatus in which the photoreceptor is charged by applying only direct-current voltage to a charging member that contacts the photoreceptor. The mechanism thereof has been still studied but is speculated as follows.

In the field of electrophotography, cheap apparatuses with a prolonged lifetime have been demanded these days; for example, a charging device that performs charging in which only direct-current voltage is applied to the charging member which contacts an electrophotographic photoreceptor (hereinafter referred to as "DC contact charging") is employed. Use of such a charging device of DC contact charging, however, causes the occurrence of unintended fine colored lines as image defects in some cases.

The occurrence of fine colored lines is believed to be attributed to the frequency of electric discharge (hereinafter referred to as "discharge frequency") that occurs between the photoreceptor and the charging member. An example of this electric discharge that occurs in an image forming apparatus of the contact charging in which the charging member contacts the surface of a photoreceptor is electric discharge that occurs at a space (fine gap) generated by separation of the charging member from the photoreceptor after the contact thereof (post-discharge). The lower the discharge frequency is, the more the electric discharge becomes uneven; thus, the surface of the photoreceptor is likely to be unevenly charged, which leads to formation of an electrostatic latent image that is likely to cause fine colored lines.

In the case of using a charging device of DC contact charging, the discharge frequency is likely to be low. The cause thereof is speculated to be that saturation of charges inside the photoreceptor makes it hard for electric current to flow into the photoreceptor with the result that the electric discharge is less likely to occur.

In the photoreceptor of the first exemplary embodiment, $T_2$ is approximately from 3.2 to 11.0 times as large as $T_1$. In other words, $T_2$ that is the time that takes for a current value to reach the maximum after the beginning of application of a square wave voltage to the electrophotographic photoreceptor and then decrease to one fifth of the maximum is approximately from 3.2 to 11.0 times as large as $T_1$ that is the time that takes for the current value to reach the maximum after the beginning of the application of the square wave voltage.

The time that takes from the movement of charges inside the photoreceptor due to application of voltage to saturation thereof is longer in the photoreceptor in which $T_2$ is approximately from 3.2 to 11.0 times as large as $T_1$ than in photoreceptors in which $T_2$ is below 3.2 times as large as $T_1$. In other words, since a response to charging is slow in the photoreceptor according to the first exemplary embodiment, using the photoreceptor in an image forming apparatus of DC contact charging is less likely to cause saturation of charges inside the photoreceptor, and a state in which electric discharge is easy to occur is maintained. For this reason, it is speculated that the occurrence of fine colored lines brought about by a decrease in the discharge frequency is reduced.

A photoreceptor in which $T_2$ is above 11.0 times as large as $T_1$ is regarded as a photoreceptor in which injection of charges from the substrate into the photosensitive layer is likely to occur. In the case where this injection of charges occurs after application of voltage to the photoreceptor, the electric potential of charges on the surface of the photoreceptor is reduced, which may cause an increase in image density. In the first exemplary embodiment, since $T_2$ is approximately from 3.2 to 11.0 times as large as $T_1$, an increase in image density resulting from the injection of charges is reduced as compared with a photoreceptor in which $T_2$ is above 11.0 times as large as $T_1$.

For the reason described above, it is speculated that controlling $T_2$ to be approximately from 3.2 to 11.0 times as large as $T_1$ enables a reduction in the occurrence of fine colored lines in an image forming apparatus in which a photoreceptor is charge by applying only direct-current voltage to a charging member that contacts the photoreceptor, as compared with the case where $T_2$ is below 3.2 times as large as $T_1$.

A ratio of $T_2$ to $T_1$ ($T_2/T_1$) is approximately from 3.2 to 11.0, preferably approximately from 5.0 to 10.8, and more preferably approximately from 9.0 to 10.5.

$T_1$ is not particularly limited provided that the ratio ($T_2/T_1$) is within the above-mentioned range; for instance, it is approximately from 0.010 μs to 0.050 μs, preferably from 0.020 μs to 0.040 μs, and more preferably from 0.025 μs to 0.035 μs. $T_2$ is also not particularly limited provided that the ratio ($T_2/T_1$) is within the above-mentioned range; for example, it is approximately from 0.10 μs to 0.50 μs, preferably from 0.20 μs to 0.40 μs, and more preferably from 0.25 μs to 0.35 μs.

The occurrence of fine colored lines tends to be conspicuous particularly when the thickness of the photosensitive layer is approximately 20 μm or more (in the case where the photosensitive layer includes a charge-generating layer and a charge-transporting layer, the thickness of the photosensitive layer is the total of the thicknesses of the charge-generating layer and charge-transporting layer). Controlling $T_2$ to be approximately from 3.2 to 11.0 times as large as $T_1$ enables a reduction in the occurrence of fine colored lines even when the thickness of the photosensitive layer is approximately 20 μm or more.

The thickness of the photosensitive layer is, for example, from 20 μm to 32 μm, preferably from 21 μm to 28 μm, and more preferably from 22 μm to 25 μm.

Examples of a technique for controlling the relationship between $T_1$ and $T_2$ in the photoreceptor include, but are not limited to, a technique that involves disposing an undercoat layer containing zinc oxide particles between the conductive substrate and the photosensitive layer as described below and adjusting the volume average primary particle size and specific surface area of the zinc oxide particles to control the relationship between $T_1$ and $T_2$, a technique that involves disposing an undercoat layer containing zinc oxide particles between the conductive substrate and the photosensitive layer as described below and adjusting curing temperature and curing time in the formation of the undercoat layer to control the relationship between $T_1$ and $T_2$, and a technique that involves disposing an undercoat layer containing zinc oxide particles between the conductive substrate and the photosensitive layer as described below and adjusting dispersion time of the zinc oxide particles in preparation of an undercoat-layer-forming coating liquid to control the relationship between $T_1$ and $T_2$. These techniques may be combined.

Another example of the technique for controlling the relationship between $T_1$ and $T_2$ in the photoreceptor is a technique that involves allowing the photosensitive layer to contain insulating particles to control the relationship between $T_1$ and $T_2$. In the case where the photosensitive layer includes a charge-generating layer and a charge-transporting layer, the layer containing insulating particles can be, for example, the charge-transporting layer.

The electrophotographic photoreceptor of the first exemplary embodiment will now be described in detail with reference to the drawings. In the drawings, the same or identical parts are denoted by the same reference signs, and repeated explanation is omitted.

Figure 2:
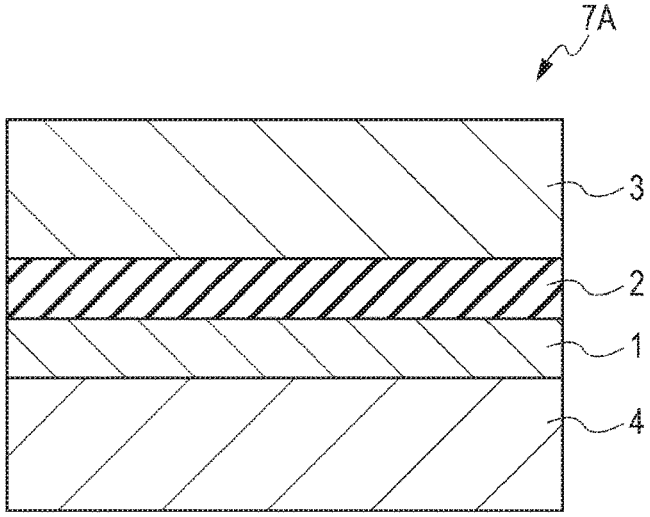
FIG. 2 is a schematic cross-sectional view illustrating an example of the layered structure of an electrophotographic photoreceptor according to a first exemplary embodiment.
Figure 3:
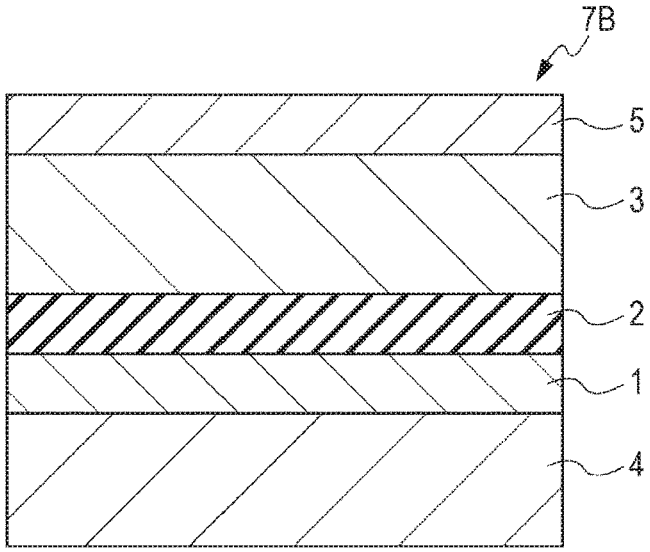
FIG. 3 is a schematic cross-sectional view illustrating another example of the layered structure of the electrophotographic photoreceptor according to the first exemplary embodiment.
Figure 4:
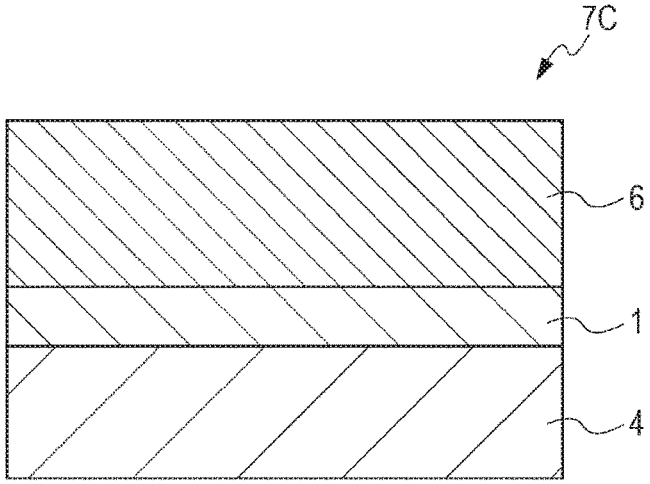
FIG. 4 is a schematic cross-sectional view illustrating another example of the layered structure of the electrophotographic photoreceptor according to the first exemplary embodiment.

FIG. 2 is a schematic cross-sectional view illustrating an example of the electrophotographic photoreceptor of the first exemplary embodiment. FIGS. 3 and 4 are each a schematic cross-sectional view illustrating another example of the electrophotographic photoreceptor of the first exemplary embodiment.

An electrophotographic photoreceptor 7A illustrated in FIG. 2 is a so-called functionally-separated photoreceptor (layered photoreceptor) and includes a conductive substrate 4; an undercoat layer 1 formed thereon; and a charge-generating layer 2 and charge-transporting layer 3 disposed in sequence so as to overlie the conductive substrate 4 and the undercoat layer 1. In the electrophotographic photoreceptor 7A, the charge-generating layer 2 and the charge-transporting layer 3 constitute the photosensitive layer.

An electrophotographic photoreceptor 7B illustrated in FIG. 3 is a functionally-separated photoreceptor in which the charge-generating layer 2 and the charge-transporting layer 3 are functionally separated as in the electrophotographic photoreceptor 7A illustrated in FIG. 2 and further includes a protective layer 5 disposed on the charge-transporting layer 3. The electrophotographic photoreceptor 7B illustrated in FIG. 3 includes the conductive substrate 4; the undercoat layer 1 formed thereon; and the charge-generating layer 2, charge-transporting layer 3, and protective layer 5 disposed in sequence so as to overlie the conductive substrate 4 and the undercoat layer 1. In the electrophotographic photoreceptor 7B, the charge-generating layer 2 and the charge-transporting layer 3 constitute the photosensitive layer as in the electrophotographic photoreceptor 7A.

In an electrophotographic photoreceptor 7C illustrated in FIG. 4, a charge-generating material and a charge-transporting material are used in a single layer [single photosensitive layer 6 (charge-generating/charge-transporting layer)]. The electrophotographic photoreceptor 7C illustrated in FIG. 4 includes the conductive substrate 4, the undercoat layer 1 formed thereon, and the single photosensitive layer 6 disposed so as to overlie the conductive substrate 4 and the undercoat layer 1.

In the electrophotographic photoreceptors illustrated in FIGS. 2 to 4, the undercoat layer 1 may be or may not be provided, and another layer (for example, intermediate layer that will be described later) may be optionally additionally provided.

In the electrophotographic photoreceptor 7C illustrated in FIG. 4, a protective layer may be further formed on the single photosensitive layer 6. The protective layer that is to be formed on the single photosensitive layer 6 may be, for instance, the same as the protective layer 5 of the electrophotographic photoreceptor 7B illustrated in FIG. 3.

Each part of the electrophotographic photoreceptor 7A illustrated in FIG. 2 will now be described as a representative example. Reference signs are omitted for the sake of convenience in some cases.

Conductive Substrate

Examples of the conductive substrate include metal plates, metal drums, and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

In the case where the electrophotographic photoreceptor is used in a laser printer, the surface of the conductive substrate is suitably roughened to a center line average roughness Ra ranging from 0.04 μm to 0.5 μm in order to reduce interference fringes generated on radiation of laser light. The roughening for the reduction in interference fringes does not need to be performed when incoherent light is emitted from a light source; however, roughening the surface of the conductive substrate reduces generation of the defect thereof, which leads to prolonged product lifetime.

Examples of a technique for the roughening include wet honing in which an abrasive is suspended in water and then sprayed to a support, centerless grinding in which a rotating grindstone is pressed against the conductive substrate to continuously grind it, and anodic oxidation.

Another roughening technique may be used; for instance, conductive or semi-conductive powder is dispersed in resin, and the layer thereof is formed on the surface of the conductive substrate, and the particles dispersed in the layer serve for the roughening without directly roughening the surface of the conductive substrate.

In the roughening by anodic oxidation, a conductive substrate formed of metal (e.g., aluminum) serves as an anode for the anodic oxidation in an electrolyte solution, thereby forming an oxidation film on the surface of the conductive substrate. Examples of the electrolyte solution include a sulfuric acid solution and an oxalic acid solution. A porous anodic oxidation film formed by anodic oxidation is, however, chemically active in its original state; thus, it is easily contaminated and suffers from a great change in resistance depending on environment. Accordingly, the pores of the porous anodic oxidation film are suitably closed owing to volume expansion resulting from a hydration reaction in pressurized steam or in boiled water (metal salt such as nickel is optionally added) to turn the oxidation film to more stable hydrous oxide.

The thickness of the anodic oxidation film is, for example, suitably from 0.3 μm to 15 μm. At a thickness in such a range, barrier properties to injection are likely to be given, and an increase in the residual potential due to repeated use is likely to be reduced.

The conductive substrate is optionally subjected to a treatment with an acidic treatment liquid or a boehmite treatment.

An example of the treatment with an acidic treatment liquid is as follows. An acidic treatment liquid containing a phosphoric acid, a chromic acid, and a hydrofluoric acid is prepared. The amounts of the phosphoric acid, chromic acid, and hydrofluoric acid in the acidic treatment liquid are, for instance, from 10 weight % to 11 weight %, from 3 weight % to 5 weight %, and from 0.5 weight % to 2 weight %, respectively; the total concentration of the whole acids is suitably from 13.5 weight % to 18 weight %. The treatment temperature is, for example, suitably in the range of 42° C. to 48° C. The thickness of the coating film is suitably from 0.3 μm to 15 μm.

The boehmite treatment, for instance, involves a soak in pure water at a temperature ranging from 90° C. to 100° C. for from 5 to 60 minutes or contact with heated steam at a temperature ranging from 90° C. to 120° C. for from 5 to 60 minutes. The thickness of the coating film is suitably from 0.1 μm to 5 μm. The coating film is optionally further subjected to an anodic oxidation treatment with an electrolyte solution that less dissolves the coating film, such as adipic acid, boric acid, borate, phosphate, phthalate, maleate, benzoate, tartrate, or citrate.

Undercoat Layer

An example of the undercoat layer is a layer containing inorganic particles and a binder resin.

Examples of the inorganic particles include inorganic particles having a powder resistance (volume resistivity) ranging from $10^2$ Ωcm to $10^{11}$ Ωcm.

Specific examples of the inorganic particles having such a resistance include metal oxide particles such as tin oxide particles, titanium oxide particles, zinc oxide particles, and zirconium oxide particles; in particular, zinc oxide particles are suitable.

The specific surface area of the inorganic particles, which is measured by a BET method, is, for example, suitably 10 $m^2/g$ or more.

The volume average particle size of the inorganic particles is, for instance, suitably from 50 nm to 2000 nm (preferably from 60 nm to 1000 nm).

As described above, the undercoat layer containing zinc oxide particles may be formed between the conductive substrate and the photosensitive layer, and the volume average primary particle size and specific surface area of the zinc oxide particles may be adjusted to control the relationship between $T_1$ and $T_2$ in the photoreceptor. In other words, zinc oxide particles having a volume average primary particle size and specific surface area within the following ranges may be used as the inorganic particles contained in the undercoat layer in order to control the relationship between $T_1$ and $T_2$ in the photoreceptor.

The volume average primary particle size of the zinc oxide particles is preferably approximately from 60 nm to 200 nm, more preferably from 70 nm to 150 nm, and further preferably approximately from 80 nm to 95 nm.

The specific surface area of the zinc oxide particles is preferably from 8 $m^2/g$ to 20 $m^2/g$, more preferably from 9 $m^2/g$ to 18 $m^2/g$, and further preferably approximately from 10 $m^2/g$ to 15 $m^2/g$.

Adjusting the volume average primary particle size and specific surface area of the zinc oxide particles to be within such ranges makes it easy to produce a photoreceptor in which the ratio of $T_2$ to $T_1$ ($T_2/T_1$) is large as compared with the case where the volume average primary particle size is below the range or where the specific surface area is above the range. Hence, the occurrence of fine colored lines is reduced.

Adjusting the volume average primary particle size and specific surface area of the zinc oxide particles to be within the above-mentioned ranges enables easy production of charging properties in terms of adjustment of the resistance of the undercoat layer as compared with the case where the volume average primary particle size is above the range or where the specific surface area is below the range.

The volume average primary particle size of the zinc oxide particles is measured with a laser-diffraction particle size distribution analyzer (LA-700, manufactured by HORIBA, Ltd.). In particular, a sample (namely, zinc oxide particles to be analyzed) in the form of a dispersion liquid is adjusted so as to have a solid content of 2 g, and ion exchanged water is added thereto to 40 ml. This liquid is put into cells to proper concentration and left for two minutes, and then the volume average primary particle size is measured. The measured particle sizes of the individual channels are accumulated in ascending order on a volume basis, and the particle size at 50% accumulation is defined as the volume average primary particle size.

The specific surface area of the zinc oxide particles refers to a specific surface area measured by a BET method and is determined as follows. Specifically, the measurement is carried out by a three-point method with a specific surface area analyzer SA3100 (manufactured by Beckman Coulter, Inc.). In particular, 5 g of a sample (namely, zinc oxide particles to be analyzed) is put into a cell and degassed at 60° C. for 120 minutes, and the specific surface area is measured with a mixture of nitrogen gas and helium gas (volume ratio of 30:70).

The amount of the inorganic particles is, for example, preferably from 10 weight % to 80 weight %, and more preferably from 40 weight % to 80 weight % relative the amount of the binder resin.

The inorganic particles are optionally subjected to a surface treatment. Two or more types of inorganic particles subjected to different surface treatments or having different particle sizes may be used in combination.

Examples of a surface treatment agent to be used include a silane coupling agent, a titanate-based coupling agent, an aluminum-based coupling agent, and a surfactant. In particular, a silane coupling agent is preferred, and a silane coupling agent having an amino group is more preferred.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination; for example, the silane coupling agent having an amino group may be used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Any of known surface treatments with surface treatment agents may be employed, and either of a dry process and a wet process may be performed.

The amount of the surface treatment agent to be used is, for instance, suitably from 0.5 weight % to 10 weight % relative to the inorganic particle content.

The undercoat layer may contain an electron-accepting compound (acceptor compound) in addition to the inorganic particles in terms of enhancements in the long-term stability of electric properties and carrier-blocking properties.

Examples of the electron-accepting compound include electron-transporting materials, for instance, quinone compounds such as chloranil and bromoanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, the electron-accepting compound is suitably a compound having an anthraquinone structure. Suitable examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer in a state in which it is dispersed along with the inorganic particles or in a state it is adhering to the surfaces of the inorganic particles.

The electron-accepting compound is allowed to adhere to the surfaces of the inorganic particles through, for example, a dry process or a wet process.

In a dry process, for instance, the inorganic particles are stirred with a mixer or another equipment having a large shear force, and the electron-accepting compound itself or a solution of the electron-accepting compound in an organic solvent is dropped or sprayed with dry air or nitrogen gas thereto under the stirring, thereby allowing the electron-accepting compound to adhere to the surfaces of the inorganic particles. The dropping or spraying of the electron-accepting compound may be performed at a temperature less than or equal to the boiling point of the solvent. After the dropping or spraying of the electron-accepting compound, the resulting product may be optionally baked at 100° C. or more. The baking may be performed at any temperature for any length of time provided that electrophotographic properties can be produced.

In a wet process, for example, the inorganic particles are dispersed in a solvent by a technique that involves use of stirring, ultrasonic, a sand mill, an attritor, or a ball mill; the electron-accepting compound is added thereto and then stirred or dispersed; and the solvent is subsequently removed, thereby allowing the electron-accepting compound to adhere to the surfaces of the inorganic particles. The solvent is removed, for instance, by filtration or distillation. After the removal of the solvent, the resulting product may be optionally baked at 100° C. or more. The baking may be performed at any temperature for any length of time provided that electrophotographic properties can be produced. In the wet process, the moisture content in the inorganic particles may be removed before the addition of the electron-accepting compound; examples of a technique for the removal include a technique in which the moisture is removed in a solvent under stirring and heating and a technique in which the moisture is removed through azeotropy with a solvent.

The electron-accepting compound may be allowed to adhere to the surfaces of the inorganic particles before or after the inorganic particles are subjected to the surface treatment with a surface treatment agent, and the process for the adhesion of the electron-accepting compound and the surface treatment may be performed at the same time.

The amount of the electron-accepting compound is, for example, suitably from 0.01 weight % to 20 weight %, and preferably from 0.01 weight % to 10 weight % relative to the inorganic particle content.

Examples of the binder resin used for forming the undercoat layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin used for forming the undercoat layer include charge-transporting resins having charge-transporting groups and conductive resins (e.g., polyaniline).

The binder resin used for forming the undercoat layer is suitably insoluble in a solvent used to form the upper layer. In particular, suitable resins are thermosetting resins, such as urea resins, phenolic resins, phenol-formaldehyde resins, melamine resins, urethane resins, unsaturated polyester resins, alkyd resins, and epoxy resins, and resins produced through the reaction of a curing agent with at least one resin selected from the group consisting of polyamide resins, polyester resins, polyether resins, methacrylic resins, acrylic resins, polyvinyl alcohol resins, and polyvinyl acetal resins.

In the case where two or more of these binder resins are used in combination, the mixture ratio is appropriately determined.

The undercoat layer may contain a variety of additives to enhance electric properties, environmental stability, and image quality.

Examples of the additives include known materials such as electron-transporting pigments (e.g., condensed polycyclic pigments and azo pigments), zirconium chelate compounds, titanium chelate compounds, aluminum chelate compounds, titanium alkoxide compounds, organic titanium compounds, and silane coupling agents. A silane coupling agent is used for the surface treatment of the inorganic particles as described above; however, it may be further added, as an additive, to the undercoat layer.

Examples of the silane coupling agents as the additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, ammonium salts of titanium lactate, titanium lactate, ethyl esters of titanium lactate, titanium triethanol aminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or in the form of a mixture or polycondensate of multiple compounds.

The undercoat layer desirably has a Vickers hardness of 35 or more.

The surface roughness (ten-point average roughness) of the undercoat layer is desirably adjusted to be from ¼n (n is a refractive index of the upper layer) to ½ of the wavelength λ of laser light to be used for exposure in order to reduce Moire fringes.

The undercoat layer may contain, for example, resin particles in order to adjust the surface roughness. Examples of the resin particles include silicone resin particles and crosslinkable polymethyl methacrylate resin particles. The surface of the undercoat layer may be polished to adjust the surface roughness. Examples of a polishing technique include buff polishing, sandblasting, wet honing, and grinding.

The undercoat layer may be formed by any of known techniques; for instance, the above-mentioned components are added to a solvent to prepare a coating liquid used for forming the undercoat layer, the coating liquid is used to form a coating film, and the coating film is dried and optionally heated.

Examples of the solvent used in the preparation of the coating liquid used for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of such solvents include typical organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a technique for dispersing the inorganic particles in the preparation of the coating liquid used for forming the undercoat layer include known techniques that involve use of a roll mill, a ball mill, a vibratory ball mill, an attritor, a sand mill, a colloid mill, or a paint shaker.

Examples of a technique for applying the coating liquid used for forming the undercoat layer onto the conductive substrate include typical techniques such as blade coating, wire bar coating, spray coating, dip coating, bead coating, air knife coating, and curtain coating.

As described above, the relationship between $T_1$ and $T_2$ in the photoreceptor may be controlled by forming an undercoat layer containing zinc oxide particles between the conductive substrate and the photosensitive layer and adjusting curing temperature and curing time in the formation of the undercoat layer. In particular, in order to control the relationship between $T_1$ and $T_2$ in the photoreceptor, zinc oxide particles are used as the inorganic particles contained in the undercoat layer, a coating film of the coating liquid used for forming the undercoat layer is heated to be cured in the formation of the undercoat layer, and the curing temperature and curing time may be adjusted to be within the ranges that will be described below. The coating film may be cured after or during the drying of the coating film.

The curing temperature is, for example, from 120° C. to 220° C., preferably from 150° C. to 200° C., and more preferably from 170° C. to 190° C.

The curing time is, for instance, from 10 minutes to 60 minutes, preferably from 15 minutes to 45 minutes, and more preferably from 20 minutes to 40 minutes.

Adjusting the curing temperature and curing time to be within such ranges makes it easy to produce a photoreceptor in which a ratio of $T_2$ to $T_1$ ($T_2/T_1$) is large as compared with the case where the curing temperature is above the range or where the curing time is above the range.

As described above, the relationship between $T_1$ and $T_2$ in the photoreceptor may be controlled also by forming an undercoat layer containing zinc oxide particles between the conductive substrate and the photosensitive layer and adjusting the dispersion time of the zinc oxide particles in preparation of the coating liquid used for forming the undercoat layer. In particular, in order to control the relationship between $T_1$ and $T_2$ in the photoreceptor, zinc oxide particles are used as the inorganic particles contained in the undercoat layer, and the dispersion time of the zinc oxide particles may be adjusted in the preparation of the coating liquid used for forming the undercoat layer. A decrease in the dispersion time makes it easier to produce a photoreceptor in which a ratio of $T_2$ to $T_1$ ($T_2/T_1$) is large.

The thickness of the undercoat layer is, for example, preferably 15 μm or more, and more preferably from 20 μm to 50 μm.

Intermediate Layer

Although not illustrated, an intermediate layer may be further provided between the undercoat layer and the photosensitive layer.

An example of the intermediate layer is a layer containing resin. Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

These compounds used for forming the intermediate layer may be used alone or in the form of a mixture or polycondensate of multiple compounds.

In particular, the intermediate layer is suitably a layer containing an organic metal compound that contains a zirconium atom or a silicon atom.

The intermediate layer may be formed by any of known techniques; for instance, the above-mentioned components are added to a solvent to prepare a coating liquid used for forming the intermediate layer, the coating liquid is used to form a coating film, and the coating film is dried and optionally heated.

Examples of a technique for applying the coating liquid used for forming the intermediate layer include typical techniques such as dip coating, push-up coating, wire bar coating, spray coating, blade coating, knife coating, and curtain coating.

The thickness of the intermediate layer is suitably adjusted to be, for instance, from 0.1 μm to 3 μm. The intermediate layer may serve as the undercoat layer.

Charge-Generating Layer

An example of the charge-generating layer is a layer containing a charge-generating material and a binder resin. The charge-generating layer may be a deposited layer of a charge-generating material. The deposited layer of a charge-generating material is suitable for the case in which an incoherent light source such as a light emitting diode (LED) or an organic electro-luminescence (EL) image array is used.

Examples of the charge-generating material include azo pigments such as bisazo pigments and trisazo pigments; fused ring aromatic pigments such as dibromoanthanthrone; perylene pigments; pyrrolopyrrole pigments; phthalocyanine pigments; zinc oxide; and trigonal selenium.

In particular, suitable charge-generating materials to enable exposure to laser light having a wavelength that is in a near infrared region are metal phthalocyanine pigments and metal-free phthalocyanine pigments. Specific examples thereof include hydroxygallium phthalocyanine, chlorogallium phthalocyanine, dichlorotin phthalocyanine, and titanyl phthalocyanine.

Suitable charge-generating materials to enable exposure to laser light having a wavelength that is in a near ultraviolet region are fused ring aromatic pigments such as dibromoanthanthrone, thioindigo pigments, porphyrazine compounds, zinc oxide, trigonal selenium, and bisazo pigments.

The above-mentioned charge-generating materials may be used also in the case where an incoherent light source such as an LED or organic EL image array having a central emission wavelength ranging from 450 nm to 780 nm is used; however, when the photosensitive layer has a thickness of 20 μm or less in terms of resolution, the field intensity in the photosensitive layer becomes high, which easily results in a decrease in the degree of charging due to electric charges injected from the substrate, namely the occurrence of image defects called black spots. This phenomenon is more likely to be caused in the case of using charge-generating materials that are p-type semiconductors and that easily generate dark current, such as trigonal selenium and a phthalocyanine pigment.

Use of charge-generating materials that are n-type semiconductors, such as fused ring aromatic pigments, perylene pigments, and azo pigments, is less likely to generate dark current and enables a reduction in the occurrence of image defects called black spots even at the reduced thickness of the photosensitive layer.

In order to distinguish an n-type charge-generating material, a time-of-flight technique that has been generally employed is used to analyze the polarity of flowing photoelectric current, and a material in which electrons are likely to flow as carriers rather than holes is determined as an n-type charge-generating material.

The binder resin used for forming the charge-generating layer is selected from a variety of insulating resins and may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (such as a polycondensate made from a bisphenol and an aromatic divalent carboxylic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" herein refers to a volume resistivity of $10^{13}$ Ωm or more.

These binder resins may be used alone or in combination.

The mixture ratio of the charge-generating material to the binder resin is suitably from 10:1 to 1:10 on a weight basis.

The charge-generating layer may further contain a known additive.

The charge-generating layer may be formed by any of known techniques; for instance, the above-mentioned components are added to a solvent to prepare a coating liquid used for forming the charge-generating layer, the coating liquid is used to form a coating film, and the coating film is dried and optionally heated. The charge-generating layer may be formed by depositing the charge-generating material. Such formation of the charge-generating layer by deposition is suitable particularly in the case of using a fused ring aromatic pigment or a perylene pigment as the charge-generating material.

Examples of the solvent used in the preparation of the coating liquid used for forming the charge-generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination.

Particles (e.g., charge-generating material) are, for example, dispersed in the coating liquid used for forming the charge-generating layer with a disperser involving use of media, such as a ball mill, a vibratory ball mill, an attritor, a sand mill, or horizontal sand mill, or with a media-free disperser such as a stirrer, an ultrasonic disperser, a roll mill, and a high-pressure homogenizer. Examples of the high-pressure homogenizer include an impact-type homogenizer in which a highly pressurized dispersion liquid is allowed to collide with another liquid or a wall for dispersion and a through-type homogenizer in which a highly pressurized dispersion liquid is allowed to flow through a fine flow channel for dispersion.

In this dispersion procedure, it is effective that the average particle size of the charge-generating material used in the coating liquid for forming the charge-generating layer is 0.5 μm or less, preferably 0.3 μm or less, and more preferably 0.15 μm or less.

Examples of a technique for applying the coating liquid used for forming the charge-generating layer onto the undercoat layer (or intermediate layer) include typical techniques such as blade coating, wire bar coating, spray coating, dip coating, bead coating, air knife coating, and curtain coating.

The thickness of the charge-generating layer is, for example, adjusted to be suitably from 0.1 μm to 5.0 μm, and preferably from 0.2 μm to 2.0 μm.

Charge-Transporting Layer

An example of the charge-transporting layer is a layer containing a charge-transporting material and a binder resin. The charge-transporting layer may be a layer containing a charge-transporting polymeric material.

Examples of the charge-transporting material include electron-transporting compounds, e.g., quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge-transporting material include hole-transporting compounds such as triarylamine compounds, benzidine compounds, arylalkane compounds, aryl-substituted ethylene compounds, stilbene compounds, anthracene compounds, and hydrazone compounds. These charge-transporting materials are used alone or in combination but not limited thereto.

The charge-transporting material is suitably any of triarylamine derivatives represented by Structural Formula (a-1) or any of benzidine derivatives represented by Structural Formula (a-2) in terms of charge mobility.

(a-1)

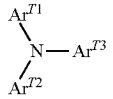

In Structural Formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$ $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent of each of these groups include a halogen atom, an alkyl group having from 1 to 5 carbon atoms, and an alkoxy group having from 1 to 5 carbon atoms. Another example of the substituent is a substituted amino group that is substituted with an alkyl group having from 1 to 3 carbon atoms.

(a-2)

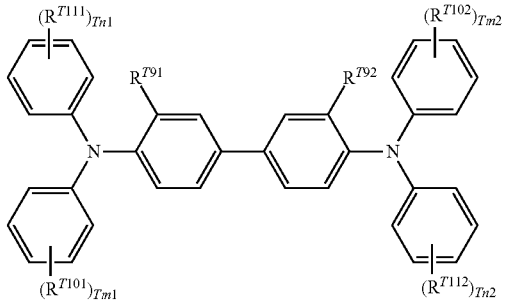

In Structural Formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$, and $R_{T112}$ each independently represent a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, —C($R^{T12}$)═C($R^{T13}$)($R^{T14}$), or —CH═CH—CH═C($R^{T15}$), ($R^{T16}$); $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer from 0 to 2.

Examples of the substituent of each of these groups include a halogen atom, an alkyl group having from 1 to 5 carbon atoms, and an alkoxy group having from 1 to 5 carbon atoms. Another example of the substituent is a substituted amino group that is substituted with an alkyl group having from 1 to 3 carbon atoms.

Among the triarylamine derivatives represented by Structural Formula (a-1) and the benzidine derivatives represented by Structural Formula (a-2), a triarylamine derivative having a part "—$C_6H_4$—CH═CH—CH═C($R^{T7}$)($R^{T8}$)" and a benzidine derivative having a part "—CH═CH—CH═C($R^{T15}$) ($R^{T16}$)" are suitable in terms of charge mobility.

Examples of the charge-transporting polymeric material include known materials having a charge transportability, such as poly-N-vinylcarbazole and polysilane. In particular, charge-transporting polymeric materials involving polyester are suitable. The charge-transporting polymeric material may be used alone or in combination with a binder resin.

Examples of the binder resin used in the charge-transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are suitably used as the binder resin. These binder resins are used alone or in combination.

The mixing ratio of the charge-transporting material to the binder resin is suitably from 10:1 to 1:5 on a weight basis.

The binder resin used in the charge-transporting layer is preferably a polycarbonate resin, and more preferably a biphenyl-copolymer-type polycarbonate resin containing a structural unit having a biphenyl skeleton (hereinafter referred to as "BP polycarbonate resin") in terms of the wear resistance of the charge-transporting layer.

Examples of the BP polycarbonate resin include biphenyl-copolymer-type polycarbonate resins having a structural unit represented by General Formula (PCA), which will be described later, as the structural unit having a biphenyl skeleton and another structural unit.

Examples of such another structural unit include structural units having bisphenol skeletons (such as bisphenol A, bisphenol B, bisphenol BP, bisphenol C, bisphenol F, and bisphenol Z).

Specific examples of the BP polycarbonate resins include copolymers of a dihydroxybiphenyl compound with a dihydroxybisphenol compound. Such copolymers can be produced by, for example, a technique involving use of a dihydroxybiphenyl compound and a dihydroxybisphenol compound as raw materials and polycondensation with a carbonate-forming compound, such as phosgene, or transesterification with bisaryl carbonate.

The dihydroxybiphenyl compound is a biphenyl compound having a biphenyl skeleton of which one hydroxyl group is present on each of the two benzene rings. Examples of the dihydroxybiphenyl compound include 4,4'-dihydroxybiphenyl, 4,4'-dihydroxy-3,3'-dimethylbiphenyl, 4,4'-dihydroxy-2,2'-dimethylbiphenyl, 4,4'-dihydroxy-3,3'-dicyclohexylbiphenyl, 3,3'-difluoro-4,4'-dihydroxybiphenyl, and 4,4'-dihydroxy-3,3'-diphenylbiphenyl.

These dihydroxybiphenyl compounds may be used alone or in combination.

The dihydroxybisphenol compound is a bisphenol compound having a bisphenol skeleton of which one hydroxyl group is present on each of the two benzene rings. Examples of the dihydroxybisphenol compound include bis(4-hydroxyphenyl)methane, 1,1-bis(4-hydroxyphenyl)ethane, 1,2-bis(4-hydroxyphenyl)ethane, 2,2-bis(4-hydroxyphenyl)propane, 2,2-bis(3-methyl-4-hydroxyphenyl)butane, 2,2-bis(4-hydroxyphenyl)butane, 2,2-bis(4-hydroxyphenyl)octane, 4,4-bis(4-hydroxyphenyl)heptane, 1,1-bis(4-hydroxyphenyl)-1,1-diphenylmethane, 1,1-bis(4-hydroxyphenyl)-1-phenylethane, 1,1-bis(4-hydroxyphenyl)-1-phenylmethane, bis(4-hydroxyphenyl)ether, bis(4-hydroxyphenyl)sulfide, bis(4-hydroxyphenyl)sulfone, 1,1-bis(4-hydroxyphenyl)cyclopentane, 1,1-bis(4-hydroxyphenyl)cyclohexane, 2,2-bis(3-methyl-4-hydroxyphenyl)propane, 2-(3-methyl-4-hydroxyphenyl)-2-(4-hydroxyphenyl)-1-phenylethane, bis(3-methyl-4-hydroxyphenyl)sulfide, bis(3-methyl-4-hydroxyphenyl)sulfone, bis(3-methyl-4-hydroxyphenyl)methane, 1,1-bis(3-methyl-4-hydroxyphenyl)cyclohexane, 2,2-bis(2-methyl-4-hydroxyphenyl)propane, 1,1-bis(2-butyl-4-hydroxy-5-methylphenyl)butane, 1,1-bis(2-tert-butyl-4-hydroxy-3-methylphenyl)ethane, 1,1-bis(2-tert-butyl-4-hydroxy-5-methylphenyl)propane, 1,1-bis(2-tert-butyl-4-hydroxy-5-methylphenyl)butane, 1,1-bis(2-tert-butyl-4-hydroxy-5-methylphenyl)isobutane, 1,1-bis(2-tert-butyl-4-hydroxy-5-methylphenyl)heptane, 1,1-bis(2-tert-butyl-4-hydroxy-5-methylphenyl)-1-phenylmethane, 1,1-bis(2-tert-amyl-4-hydroxy-5-methylphenyl)butane, bis(3-chloro-4-hydroxyphenyl)methane, bis(3,5-dibromo-4-hydroxyphenyl)methane, 2,2-bis(3-chloro-4-hydroxyphenyl)propane, 2,2-bis(3-fluoro-4-hydroxyphenyl)propane, 2,2-bis(3-bromo-4-hydroxyphenyl)propane, 2,2-bis(3,5-difluoro-4-hydroxyphenyl)propane, 2,2-bis(3,5-dichloro-4-hydroxyphenyl)propane, 2,2-bis(3,5-dibromo-4-hydroxyphenyl)propane, 2,2-bis(3-bromo-4-hydroxy-5-chlorophenyl)propane, 2,2-bis(3,5-dichloro-4-hydroxyphenyl)butane, 2,2-bis(3,5-dibromo-4-hydroxyphenyl)butane, 1-phenyl-1,1-bis(3-fluoro-4-hydroxyphenyl)ethane, bis(3-fluoro-4-hydroxyphenyl)ether, and 1,1-bis(3-cyclohexyl-4-hydroxyphenyl)cyclohexane.

These bisphenol compounds may be used alone or in combination.

In particular, the BP polycarbonate resin is suitably a polycarbonate resin having the structural unit represented by General Formula (PCA) and a structural unit represented by General Formula (PCB) in view of the wear resistance of the charge-transporting layer.

(PCA)

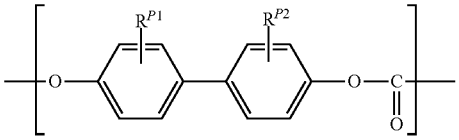

-continued (PCB)

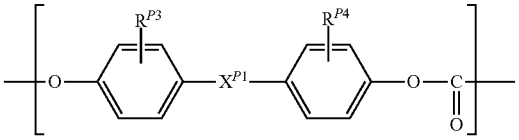

In General Formulae (PCA) and (PCB), $R^{P1}$, $R^{P2}$, $R^{P3}$, and $R^{P4}$ each independently represent a hydrogen atom, a halogen atom, an alkyl group having from 1 to 6 carbon atoms, a cycloalkyl group having from 5 to 7 carbon atoms, or an aryl group having from 6 to 12 carbon atoms. $X^{P1}$ represents a phenylene group, a biphenylene group, a naphthylene group, an alkylene group, or a cycloalkylene group.

In General Formulae (PCA) and (PCB), the alkyl group represented by $R^{P1}$, $R^{P2}$, $R^{P3}$, and $R^{P4}$ is, for example, a linear or branched alkyl group having from 1 to 6 carbon atoms (preferably from 1 to 3 carbon atoms).

Specific examples of the linear alkyl group include a methyl group, an ethyl group, an n-propyl group, an n-butyl group, an n-pentyl group, and an n-hexyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, and a tert-hexyl group.

Of these, the alkyl group is suitably a lower alkyl group such as a methyl group or an ethyl group.

In General Formulae (PCA) and (PCB), the cycloalkyl group represented by $R^{P1}$, $R^{P2}$, $R^{P3}$, and $R^{P4}$ is, for instance, cyclopentyl, cyclohexyl, or cycloheptyl.

In General Formulae (PCA) and (PCB), the aryl group represented by $R^{P1}$, $R^{P2}$, $R^{P3}$, and $R^{P4}$ is, for example, a phenyl group, a naphthyl group, or a biphenylyl group.

In General Formulae (PCA) and (PCB), examples of the alkylene group represented by $X^{P1}$ include linear or branched alkylene groups having from 1 to 12 carbon atoms (preferably from 1 to 6 carbon atoms, and more preferably from 1 to 3 carbon atoms).

Specific examples of the linear alkylene group include a methylene group, an ethylene group, an n-propylene group, an n-butylene group, an n-pentylene group, an n-hexylene group, an n-heptylene group, an n-octylene group, an n-nonylene group, an n-decylene group, an n-undecylene group, and an n-dodecylene group.

Specific examples of the branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isoundecylene group, a sec-undecylene group, a tert-undecylene group, a neoundecylene group, an isododecylene group, a sec-dodecylene group, a tert-dodecylene group, and a neododecylene group.

Among these, the alkylene group is suitably a lower alkylene group such as a methylene group, an ethylene group, or a butylene group.

In General Formulae (PCA) and (PCB), examples of the cycloalkylene group represented by $X^{P1}$ include cycloalkylene groups having from 3 to 12 carbon atoms (preferably from 3 to 10 carbon atoms, and more preferably from 5 to 8 carbon atoms).

Specific examples of the cycloalkylene group include a cyclopropylene group, a cyclopentylene group, a cyclohexylene group, a cyclooctylene group, and a cyclododecanylene group.

Among these, the cycloalkylene group is suitably a cyclohexylene group.

In General Formulae (PCA) and (PCB), each of the substituents represented by $R^{P1}$, $R^{P2}$, $R^{P3}$, $R^{P4}$, and $X^{P1}$ includes a group additionally having a substituent. Examples of this substituent include halogen atoms (for instance, a fluorine atom and a chlorine atom), alkyl groups (for instance, an alkyl group having from 1 to 6 carbon atoms), cycloalkyl groups (for instance, a cycloalkyl group having from 5 to 7 carbon atoms), alkoxy groups (for instance, an alkoxy group having from 1 to 4 carbon atoms), and aryl groups (for instance, a phenyl group, a naphthyl group, and a biphenylyl group).

In General Formula (PCA), $R^{P1}$ and $R^{P2}$ each independently preferably represent a hydrogen atom or an alkyl group having from 1 to 6 carbon atoms, and more preferably a hydrogen atom.

In General Formula (PCB), $R^{P3}$ and $R^{P4}$ each independently suitably represent a hydrogen atom or an alkyl group having from 1 to 6 carbon atoms, and $X^{P1}$ suitably represent an alkylene group or a cycloalkylene group.

Specific examples of the BP polycarbonate resin include, but are not limited to, the following compounds. In the exemplified compounds, pm and pn each indicate a copolymerization ratio.

(PC-1)

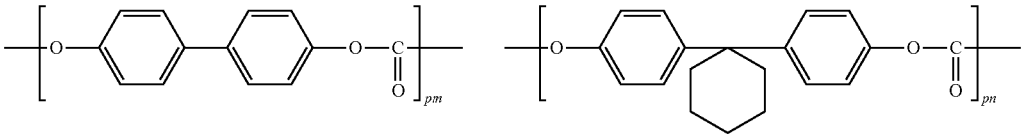

(PC-2)

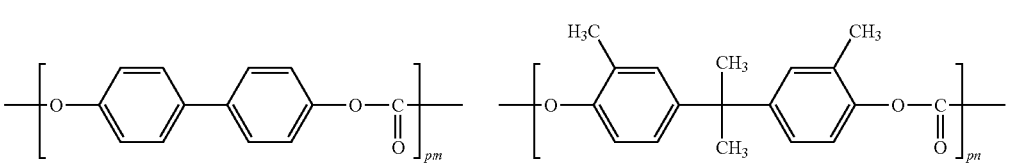

-continued (PC-3)

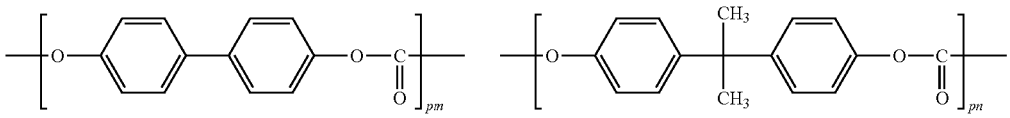

In the BP polycarbonate resin, the content percentage (copolymerization ratio) of the structural unit represented by General Formula (PCA) is from 5 mol % to 95 mol % relative to all the structural units constituting the BP polycarbonate resin; in view of an enhancement in the wear resistance of the photosensitive layer (charge-transporting layer), it is preferably from 5 mol % to 50 mol %, and more preferably from 15 mol % to 30 mol %.

Specifically, in the above-mentioned compounds given as examples of the BP polycarbonate resin, pm and pn refer to the copolymerization ratio (molar ratio); and pm:pn is from 95:5 to 5:95, preferably from 50:50 to 5:95, and more preferably from 15:85 to 30:70.

The viscosity average molecular weight of the BP polycarbonate resin is, for example, suitably from 20,000 to 80,000.

The viscosity average molecular weight of the BP polycarbonate resin is measured as follows. In 100 $cm^3$ of methylene chloride, 1 g of resin is uniformly dissolved. Specific viscosity ηsp thereof is measured with a Ubbelohde viscometer at 25° C., limiting viscosity [η] ($cm^3/g$) is determined from a relational expression of $\eta sp/c=[\eta]+0.45[\eta]^2c$ [where c is concentration ($g/cm^3$)], and a viscosity average molecular weight Mv is determined from an expression given by H. Schnell, which is a relational expression of $[\eta]=1.23\times10^{-4}\,Mv^{0.83}$.

The BP polycarbonate resin may be used in combination with another binder resin. Such another binder resin can be used in an amount of 10 weight % (suitably 5 weight % or less) relative to the whole binder resin content.

The BP polycarbonate resin content is, for example, preferably from 10 weight % to 90 weight %, more preferably from 30 weight % to 90 weight %, and further preferably from 50 weight % to 90 weight % relative to the entire solid content of the photosensitive layer (charge-transporting layer).

The charge-transporting layer may further contain a known additive.

The charge-transporting layer may contain fluorine-containing resin particles.

Examples of the fluorine-containing resin particles include resin particles that contain fluorine atoms. The fluorine-containing resin particles are, for instance, suitably one or more types of particles selected from particles of a tetrafluoroethylene resin, a chlorotrifluoroethylene resin, a hexafluoropropylene resin, a vinyl fluoride resin, a vinylidene fluoride resin, a dichlorodifluoroethylene resin, and copolymers thereof. Among these, the fluorine-containing resin particles are desirably tetrafluoroethylene resin particles and vinylidene fluoride resin particles.

The number average primary particle size of the fluorine-containing resin particles can be from 0.05 μm to 1 μm, and desirably from 0.1 μm to 0.5 μm.

The number average primary particle size is determined as follows: a sample piece is taken from the photosensitive layer (charge-transporting layer); the sample piece is observed with a scanning electron microscope (SEM) at, for example, 5000- or more folds magnification to determine the maximum particle size of a fluorine-containing resin particle in the state of a primary particle; and the same procedure is performed for 50 fluorine-containing resin particles to determine the average. The SEM to be used is JSM-6700F manufactured by JEOL Ltd. to observe a secondary electron image obtained at an acceleration voltage of 5 kV.

Examples of commercially available products of the fluorine-containing resin particles include Lubron (registered trademark) series (manufactured by DAIKIN INDUSTRIES, LTD), Teflon (registered trademark) series (manufactured by E.I. du Pont de Nemours and Company), and Dyneon (registered trademark) series (manufactured by Sumitomo 3M Limited).

The amount of the fluorine-containing resin particles is preferably from 1 weight % to 30 weight %, more preferably from 3 weight % to 20 weight %, and further preferably from 5 weight % to 15 weight % relative to the total solid content in the photosensitive layer (charge-transporting layer) in order to enhance the wear resistance of the photosensitive layer and to thus prolong the lifetime thereof.

The charge-transporting layer may contain a fluorine-containing dispersant as a dispersant for the fluorine-containing resin particles.

Examples of the fluorine-containing dispersant include polymers produced by homopolymerization or copolymerization of a polymeric compound containing an alkyl fluoride group (also referred to as "alkyl-fluoride-group-containing polymers").

Specific examples of the fluorine-containing dispersant include homopolymers of (meth)acrylate containing an alkyl fluoride group and random or block copolymers of (meth) acrylate containing an alkyl fluoride group with a monomer that is free from a fluorine atom. The term "(meth)acrylate" herein refers to both acrylate and methacrylate.

Examples of the (meth)acrylate containing an alkyl fluoride group include 2,2,2-trifluoroethyl(meth)acrylate and 2,2,3,3,3-pentafluoropropyl(meth)acrylate.

Examples of the monomer that is free from a fluorine atom include (meth)acrylate, isobutyl (meth)acrylate, t-butyl (meth)acrylate, isooctyl (meth)acrylate, lauryl (meth)acrylate, stearyl (meth)acrylate, isobornyl (meth)acrylate, cyclohexyl (meth)acrylate, 2-methoxyethyl (meth)acrylate, methoxytriethylene glycol (meth)acrylate, 2-ethoxyethyl (meth) acrylate, tetrahydrofurfuryl (meth)acrylate, benzyl (meth)acrylate, ethyl carbitol (meth)acrylate, phenoxyethyl (meth)acrylate, 2-hydroxy (meth)acrylate, 2-hydroxypropyl (meth)acrylate, 4-hydroxybutyl (meth) acrylate, methoxypolyethylene glycol (meth)acrylate, phenoxypolyethylene glycol (meth)acrylate, hydroxyethyl o-phenylphenol (meth) acrylate, and o-phenylphenol glycidylether (meth) acrylate.

Other specific examples of the fluorine-containing dispersant include block or branched polymers disclosed in U.S. Pat. No. 5,637,142 and Japanese Patent No. 4251662. Yet other specific examples of the fluorine-containing dispersant include fluorine-containing surfactants.

In particular, the fluorine-containing dispersant is preferably an alkyl-fluoride-group-containing polymer having a structural unit represented by General Formula (FA), and more preferably an alkyl-fluoride-group-containing polymer having a structural unit represented by General Formula (FA) and a structural unit represented by General Formula (FB).

The alkyl-fluoride-group-containing polymer having a structural unit represented by General Formula (FA) and a structural unit represented by General Formula (FB) will now be described.

(FA)

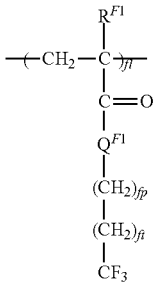

(FB)

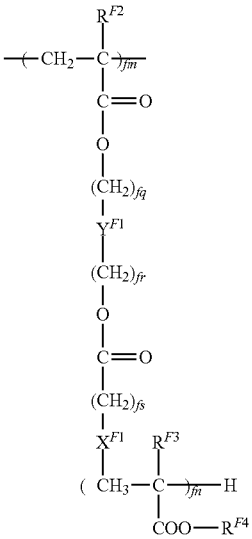

In General Formulae (FA) and (FB), $R^{F1}$, $R^{F2}$, $R^{F3}$, and $R^{F4}$ each independently represent a hydrogen atom or an alkyl group.

$X^{F1}$ represents an alkylene chain, a halogen-substituted alkylene chain, —S—, —O—, —NH—, or a single bond.

$Y^{F1}$ represents an alkylene chain, a halogen-substituted alkylene chain, —($C_{fx}$—$H_{2fx-1}$(OH))—, or a single bond.

$Q^{F1}$ represents —O— or —NH—.

fl, fm, and fn each independently represent an integer of 1 or greater.

fp, fq, fr, and fs each independently represent 0 or an integer of 1 or greater.

ft represents an integer from 1 to 7.

fx represents an integer of 1 or greater.

In General Formulae (FA) and (FB), the groups represented by $R^{F1}$, $R^{F2}$, $R^{F3}$, and $R^{F4}$ are each preferably a hydrogen atom, a methyl group, an ethyl group, or a propyl group; more preferably a hydrogen atom or a methyl group; and further preferably a methyl group.

In General Formulae (FA) and (FB), the alkylene chain (unsubstituted alkylene chain or halogen-substituted alkylene chain) represented by $X^{F1}$ and $Y^{F1}$ is suitably a linear or branched alkylene chain having from 1 to 10 carbon atoms.

fx in —($C_{fx}H_{2fx-1}$(OH))— represented by $Y^{F1}$ suitably represents an integer from 1 to 10.

fp, fq, fr, and fs each independently suitably represent 0 or an integer from 1 to 10.

fn is, for example, suitably from 1 to 60.

In the fluorine-containing dispersant, the ratio of the structural unit represented by General Formula (FA) to the structural unit represented by General Formula (FB), namely fl:fm, is preferably from 1:9 to 9:1, and more preferably from 3:7 to 7:3.

The fluorine-containing dispersant may further have a structural unit represented by General Formula (FC) in addition to the structural unit represented by General Formula (FA) and the structural unit represented by General Formula (FB). The content ratio of the total of the structural units represented by General Formulae (FA) and (FB), namely fl+fm, to the structural unit represented by General Formula (FC) (fl+fm:fz) is preferably from 10:0 to 7:3, and more preferably from 9:1 to 7:3.

(FC)

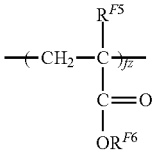

In General Formula (FC), $R^{F5}$ and $R^{F6}$ each independently represent a hydrogen atom or an alkyl group. fz is an integer of 1 or greater.

In General Formula (FC), the groups represented by $R^{F5}$ and $R^{F6}$ are each preferably a hydrogen atom, a methyl group, an ethyl group, or a propyl group; more preferably a hydrogen atom or a methyl group; and further preferably a methyl group.

Examples of commercially available products of the fluorine-containing dispersant include GF300 and GF400 (manufactured by TOAGOSEI CO., LTD.); SURFLON (registered trademark) series (manufactured by AGC SEIMI CHEMICAL CO., LTD.); FTERGENT series (manufactured by NEOS COMPANY LIMITED); PF series (manufactured by KITAMURA CHEMICALS CO., LTD.); MEGAFAC (registered trademark) series (manufactured by DIC Corporation); and FC series (manufactured by 3M Company).

The weight average molecular weight of the fluorine-containing dispersant is, for example, preferably from 2000 to 250000, more preferably from 3000 to 150000, and further preferably from 50000 to 100000.

The weight average molecular weight of the fluorine-containing dispersant is measured by gel permeation chromatography (GPC). The molecular weight is, for example, measured by GPC with a measurement apparatus of GPC·HLC-8120 manufactured by Tosoh Corporation, columns of TSKgel GMHHR-M+TSKgel GMHHR-M (I.D.: 7.8 mm, 30 cm) manufactured by Tosoh Corporation, and a chloroform solvent and calculated from result of the measurement with a calibration curve of molecular weight that is formed on the basis of a standard sample of monodisperse polystyrene.

The amount of the fluorine-containing dispersant is preferably from 1 part by weight to 5 parts by weight, more preferably from 2 parts by weight to 4 parts by weight, and further preferably 2.5 parts by weight to 3.5 parts by weight relative to 100 parts by weight of the fluorine-containing resin particles in terms of satisfying both the dispersibility of the fluorine-containing resin particles and suppression of an increase in residual potential due to repeated use.

In the first exemplary embodiment, since the outermost surface layer contains 0.01 weight % to 0.1 weight % of an organic solvent, an increase in residual potential due to repeated use can be reduced even at the fluorine-containing dispersant content within the above-mentioned range.

In the case where the charge-transporting layer contains multiple types of fluorine-containing dispersants, the term "fluorine-containing dispersant content" refers to the total amount of the multiple types of fluorine-containing dispersants contained in the charge-transporting layer.

The fluorine-containing dispersants may be used alone or in combination.

The charge-transporting layer may optionally contain an antioxidant.

Examples of the antioxidant include hindered phenol, hindered amine, paraphenylenediamine, arylalkane, hydroquinone, spirochroman, spiroindanone, derivatives thereof, organic sulfur compounds, and organic phosphorous compounds.

Specific examples of compounds as the antioxidant include phenolic antioxidants such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl) isocyanurate, tetrakis-[methylene-3-(3',5'-di-t-butyl-4'-hydroxyphenyl)propionate]-methane, and 3,9-bis[2-[3-(3-t-butyl-4-hydroxy-5-methylphenyl) propionyloxy]-1,1-dimethylethyl]-2,4,8,10-tetraoxaspiro[5,5]undecane. Examples of the hindered amine compounds include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensates, poly[{6-(1,1,3,3-tetramethylbutyl)imino-1,3,5-triazine-2,4-diyl}{(2,2,6,6-tetramethyl-4-piperidyl)imino}hexamethylene{(2,3,6,6-tetramethyl-4-piperidyl)imino}], bis(1,2,2,6,6-pentamethyl-4-piperidyl) 2-(3,5-di-t-butyl-4-hydroxybenzyl)-2-n-butylmalonate, and N,N'-bis(3-aminopropyl)ethylenediamine-2,4-bis[N-butyl-N-(1,2,2,6,6-pentamethyl-4-piperidyl)amino]-6-chloro-1,3,5-triazine condensates. Examples of the organic sulfur-containing antioxidants include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole. Examples of the organic phosphorus-containing antioxidants include trisnonylphenyl phosphite, triphenyl phosphite, and tris(2,4-di-t-butylphenyl)-phosphite.

The charge-transporting layer may optionally contain insulating particles. The charge-transporting layer, which is the photosensitive layer, is allowed to contain insulating particles to control the relationship between $T_1$ and $T_2$ as described above, and the presence of the insulating particles in the charge-transporting layer makes it easier to produce the photoreceptor having a large ratio of $T_2$ to $T_1$ ($T_2/T_1$). The mechanism thereof has been still studied but is speculated that the presence of the insulating particles in the charge-transporting layer enable an increase in the permittivity of the charge-transporting layer and that the saturation of charges be thus less likely to occur inside the photosensitive layer.

The insulating particles are not particularly limited provided that the particles have insulation properties. Examples thereof include inorganic insulating particles and insulating resin particles.

Specific examples of the inorganic insulating particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO.$SiO_2$, $K_2O$—$(TiO_2)n$, $Al_2O_3.2SiO_2$, $CaCO_3$, $MgCO_3$, $BaSO_4$, $MgSO_4$, $10CaO.3P_2O_5.H_2O$, glass, or mica.

Specific examples of the insulating resin particles include particles of polystyrene resins, polymethyl methacrylate (PMMA), melamine resins, fluorocarbon polymers, or silicone resins.

The insulating particle content in the entire charge-transporting layer is not particularly limited provided that the ratio ($T_2/T_1$) can be 3.2 or more and 11.0 or less.

The charge-transporting layer may be formed by any of known techniques; for instance, the above-mentioned components are added to a solvent to prepare a coating liquid used for forming the charge-transporting layer, the coating liquid is used to form a coating film, and the coating film is dried and optionally heated.

Examples of the solvent used in the preparation of the coating liquid used for forming the charge-transporting layer include typical organic solvents, e.g., aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or straight-chain ethers such as tetrahydrofuran and ethyl ether. These solvents are used alone or in combination.

The coating liquid used for forming the charge-transporting layer may contain silicone oil as a leveling agent in order to enhance the smoothness of the coating film.

Examples of a technique for applying the coating liquid used for forming the charge-transporting layer onto the charge-generating layer include typical techniques such as blade coating, wire bar coating, spray coating, dip coating, bead coating, air knife coating, and curtain coating.

The thickness of the charge-transporting layer is, for instance, adjusted to be preferably from 5 μm to 50 μm, and more preferably from 10 μm to 30 μm.

Protective Layer

The protective layer is optionally formed on the photosensitive layer. The protective layer is formed, for instance, in order to prevent the photosensitive layer from being chemically changed in the charging and to improve the mechanical strength of the photosensitive layer.

Hence, the protective layer is properly a layer of a cured film (crosslinked film). Examples of such a layer include the following layers (1) and (2).

(1) Layer of a cured film made of a composition that contains a reactive-group-containing charge-transporting material of which one molecule has both a reactive group and a charge-transporting skeleton (in other words, layer containing a polymer or crosslinked product of the reactive-group-containing charge-transporting material)

(2) Layer of a cured film made of a composition that contains a nonreactive charge-transporting material and a reactive-group-containing non-charge-transporting material that does not have a charge-transporting skeleton but has a reactive group (in other words, layer containing polymers or crosslinked products of the nonreactive charge-transporting material and reactive-group-containing non-charge-transporting material)

Examples of the reactive group of the reactive-group-containing charge-transporting material include known reactive groups such as a chain polymerizable group, an epoxy group, —OH, —OR (where R represents an alkyl group), —$NH_2$, —SH, —COOH, and —$SiR^{QT}_{3-Qn}(OR^{Q2})_{Qn}$ (where $R^{Q1}$ represents a hydrogen atom, an alkyl group, or a substituted or unsubstituted aryl group; $R^{Q2}$ represents a hydrogen atom, an alkyl group, or a trialkylsilyl group; and Qn represents an integer from 1 to 3).

Any chain polymerizable group may be employed provided that it is a functional group that enables a radical polymerization; for example, a functional group at least having a group with a carbon double bond may be employed. Specific examples thereof include groups containing at least one selected from a vinyl group, a vinyl ether group, a vinyl thioether group, a vinylphenyl group, an acryloyl group, a methacryloyl group, and derivatives thereof. Among these, suitable chain polymerizable groups are groups containing at least one selected from a vinyl group, a vinylphenyl group, an acryloyl group, a methacryloyl group, and derivatives thereof because they have excellent reactivity.

The charge-transporting skeleton of the reactive-group-containing charge-transporting material is not particularly limited provided that it is a known structure in the field of electrophotographic photoreceptors. Examples of such a structure include skeletons that are derived from nitrogen-containing hole-transporting compounds, such as triarylamine compounds, benzidine compounds, and hydrazone compounds, and that are conjugated with a nitrogen atom. In particular, triarylamine skeletons are suitable.

The reactive-group-containing charge-transporting material having both a reactive group and a charge-transporting skeleton, the nonreactive charge-transporting material, and the reactive-group-containing non-charge transporting material may be selected from known materials.

The protective layer may further contain a known additive.

The protective layer may be formed by any of known techniques; for instance, the above-mentioned components are added to a solvent to prepare a coating liquid used for forming the protective layer, the coating liquid is used to form a coating film, and the coating film is dried and optionally heated for curing.

Examples of the solvent used in the preparation of the coating liquid used for forming the protective layer include aromatic hydrocarbon solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or in combination.

The coating liquid used for forming the protective layer may be a solventless coating liquid.

Examples of a technique for applying the coating liquid used for forming the protective layer onto the photosensitive layer (e.g., charge-transporting layer) include typical techniques such as dip coating, push-up coating, wire bar coating, spray coating, blade coating, knife coating, and curtain coating.

The thickness of the protective layer is, for instance, adjusted to be preferably from 1 μm to 20 μm, and more preferably from 2 μm to 10 μm.

Single Photosensitive Layer

The single photosensitive layer (charge-generating/charge-transporting layer) is, for example, a layer containing a charge-generating material, a charge-transporting material, and optionally a binder resin and another known additive. These materials are the same as those described as the materials used for forming the charge-generating layer and the charge-transporting layer.

The amount of the charge-generating material contained in the single photosensitive layer is suitably from 10 weight % to 85 weight %, and preferably from 20 weight % to 50 weight % relative to the total solid content. The amount of the charge-transporting material contained in the single photosensitive layer is suitably from 5 weight % to 50 weight % relative to the total solid content.

The single photosensitive layer is formed by the same technique as those for forming the charge-generating layer and the charge-transporting layer.

The thickness of the single photosensitive layer is, for instance, suitably from 5 μm to 50 μm, and preferably from 10 μm to 40 μm.

Image Forming Apparatus (and Process Cartridge)

An image forming apparatus according to a second exemplary embodiment includes an electrophotographic photoreceptor, a charging unit that serves to apply only direct-current voltage to a charging member, which contacts the electrophotographic photoreceptor, to charge the surface of the electrophotographic photoreceptor, an electrostatic latent image forming unit that serves to form an electrostatic latent image on the charged surface of the electrophotographic photoreceptor, a developing unit that serves to develop the electrostatic latent image on the surface of the electrophotographic photoreceptor with a developer containing toner to form a toner image, and a transfer unit that serves to transfer the toner image to the surface of a recording medium. The electrophotographic photoreceptor is the electrophotographic photoreceptor according to the first exemplary embodiment.

In the image forming apparatus according to the second exemplary embodiment, a method for forming an image is carried out, the method including charging in which only direct-current voltage is applied to a charging member, which contacts the electrophotographic photoreceptor, to charge the surface of the electrophotographic photoreceptor, forming an electrostatic latent image on the charged surface of the electrophotographic photoreceptor, developing the electrostatic latent image on the surface of the electrophotographic photoreceptor with a developer containing toner to form a toner image, transferring the toner image to the surface of a recording medium.

The image forming apparatus according to the second exemplary embodiment may be any of the following known image forming apparatuses: an apparatus which has a fixing unit that serves to fix the toner image transferred to the surface of a recording medium, a direct-transfer-type apparatus in which the toner image formed on the surface of the electrophotographic photoreceptor is directly transferred to a recording medium, an intermediate-transfer-type apparatus in which the toner image formed on the surface of the electrophotographic photoreceptor is subjected to first transfer to the surface of an intermediate transfer body and in which the toner image transferred to the surface of the intermediate transfer body is then subjected to second transfer to the surface of a recording medium, an apparatus which has a cleaning unit that serves to clean the surface of the electrophotographic photoreceptor after the transfer of a toner image and before the charging of the electrophotographic photoreceptor, an apparatus which has an erasing unit that serves to radiate light to the surface of the electrophotographic photoreceptor for removal of charges after the transfer of a toner image and before the charging of the electrophotographic photoreceptor, and an apparatus which has an electrophotographic photoreceptor heating unit that serves to heat the electrophotographic photoreceptor to decrease the relative temperature.

In the second exemplary embodiment, the occurrence of fine colored lines is reduced even in an image forming apparatus that does not have an erasing unit that serves for removal of residual charges on the surface of the electrophotographic photoreceptor (for example, an erasing unit that radiates light to the surface of the electrophotographic photoreceptor for removal of charges before the charging of the electrophotographic photoreceptor) because $T_2$ is approximately from 3.2 to 11.0 times as large as $T_1$ in the electrophotographic photoreceptor.

In the intermediate-transfer-type apparatus, the transfer unit, for example, includes an intermediate transfer body of which a toner image is to be transferred to the surface, a first transfer unit which serves for first transfer of the toner image formed on the surface of the electrophotographic photoreceptor to the surface of the intermediate transfer body, and a second transfer unit which serves for second transfer of the toner image transferred to the surface of the intermediate transfer body to the surface of a recording medium.

The image forming apparatus according to the second exemplary embodiment may be either of a dry development type and a wet development type (development with a liquid developer is performed).

In the structure of the image forming apparatus according to the second exemplary embodiment, for instance, the part that includes the electrophotographic photoreceptor may be in the form of a cartridge that is removably attached to the image forming apparatus (process cartridge). A suitable example of the process cartridge to be used is a process cartridge including the electrophotographic photoreceptor according to the first exemplary embodiment. The process cartridge may include, in addition to the electrophotographic photoreceptor, at least one selected from the group consisting of, for example, the charging unit, the electrostatic latent image forming unit, the developing unit, and the transfer unit.

An example of the image forming apparatus according to the second exemplary embodiment will now be described; however, the image forming apparatus according to the second exemplary embodiment is not limited thereto. The parts shown in the drawings are described, while description of the other parts is omitted.

Figure 5:
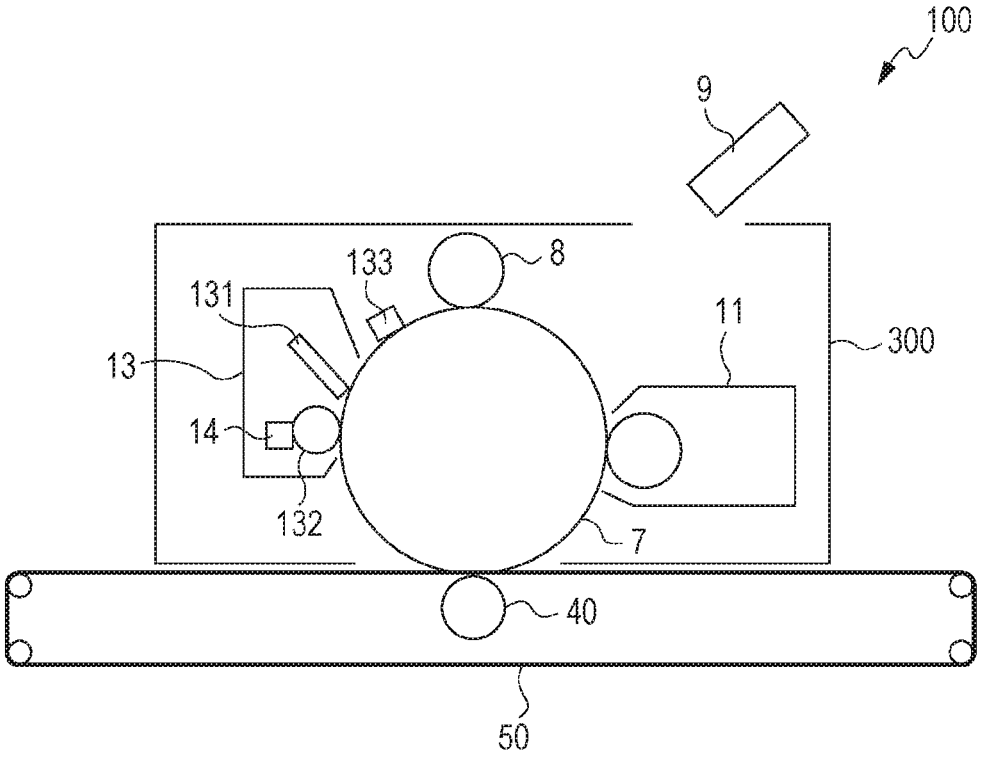
FIG. 5 schematically illustrates an example of the structure of an image forming apparatus according to a second exemplary embodiment.

FIG. 5 schematically illustrates an example of the structure of the image forming apparatus according to the second exemplary embodiment.

As illustrated in FIG. 5, an image forming apparatus 100 according to the second exemplary embodiment includes a process cartridge 300 having an electrophotographic photoreceptor 7, an exposure device 9 (example of the electrostatic latent image forming unit), a transfer device 40 (first transfer device), and an intermediate transfer body 50. In the image forming apparatus 100, the exposure device 9 is disposed such that the electrophotographic photoreceptor 7 can be irradiated with light through the opening of the process cartridge 300, the transfer unit 40 is disposed so as to face the electrophotographic photoreceptor 7 with the intermediate body 50 interposed therebetween, and the intermediate body 50 is placed such that part thereof is in contact with the electrophotographic photoreceptor 7. Although not illustrated, the image forming apparatus also includes a second transfer device that serves to transfer a toner image transferred to the intermediate transfer body 50 to a recording medium (e.g., paper). In this case, the intermediate transfer body 50, the transfer device 40 (first transfer device), and the second transfer device (not illustrated) are an example of the transfer unit.

In the process cartridge 300 illustrated in FIG. 5, a housing integrally accommodates the electrophotographic photoreceptor 7, the charging device 8 (example of the charging unit), the developing device 11 (example of the developing unit), and the cleaning device 13 (example of the cleaning unit). The cleaning device 13 has a cleaning blade 131 (example of a cleaning member), and the cleaning blade 131 is disposed so as to be in contact with the surface of the electrophotographic photoreceptor 7. The cleaning member does not need to be in the form of the cleaning blade 131 but may be a conductive or insulating fibrous member; this fibrous member may be used alone or in combination with the cleaning blade 131.

The example of the image forming apparatus in FIG. 5 includes a fibrous member 132 (roll) that serves to supply a lubricant 14 to the surface of the electrophotographic photoreceptor 7 and a fibrous member 133 (flat brush) that supports the cleaning, and these members are optionally placed.

Each part of the image forming apparatus according to the second exemplary embodiment will now be described.

Charging Device

Examples of the charging device 8 include contact-type chargers that involve use of a conductive or semi-conductive charging roller, charging brush, charging film, charging rubber blade, or charging tube.

The charging device 8 is not particularly limited provided that it can apply only direct-current voltage to the charging member that contacts the electrophotographic photoreceptor.

Exposure Device

Examples of the exposure device 9 include optical systems that expose the surface of the electrophotographic photoreceptor 7 to light, such as light emitted from a semiconductor laser, an LED, or a liquid crystal shutter, in the shape of the intended image. The wavelength of light source is within the spectral sensitivity of the electrophotographic photoreceptor. The light from a semiconductor laser is generally near-infrared light having an oscillation wavelength near 780 nm. The wavelength of the light is, however, not limited thereto; laser light having an oscillation wavelength of the order of 600 nm or blue laser light having an oscillation wavelength ranging from 400 nm to 450 nm may be employed. A surface-emitting laser source that can emit multiple beams is also effective for formation of color images.

Developing Device

Examples of the developing device 11 include general developing devices that develop images through contact or non-contact with a developer. The developing device 11 is not particularly limited provided that it has the above-mentioned function, and a proper structure for the intended use is selected. An example of the developing device 11 is a known developing device that serves to attach a one-component or two-component developer to the electrophotographic photoreceptor 7 with a brush or a roller. In particular, a developing device including a developing roller of which the surface holds a developer is suitable.

The developer used in the developing device 11 may be either of a one-component developer of toner alone and a two-component developer containing toner and a carrier. The developer may be either magnetic or nonmagnetic. Any of known developers may be used.

Cleaning Device

The cleaning device 13 is a cleaning-blade type in which the cleaning blade 131 is used.

The cleaning device 13 may have a structure other than the cleaning-blade type; in particular, fur brush cleaning may be employed, or the cleaning may be performed at the same time as the developing.

Transfer Device

Examples of the transfer device 40 include known transfer chargers such as contact-type transfer chargers having a belt, a roller, a film, or a rubber blade and non-contact-type transfer chargers in which corona discharge is utilized, e.g., a scorotron transfer charger and a corotron transfer charger.

Intermediate Transfer Body

The intermediate transfer body 50 is, for instance, in the form of a belt (intermediate transfer belt) containing a semi-conductive polyimide, polyamide imide, polycarbonate, polyarylate, polyester, or rubber. The intermediate transfer body may be in the form other than a belt, such as a drum.

The structure of the image forming apparatus 100 of the second exemplary embodiment is not limited to the above-mentioned structure and may have a known structure; for instance, a direct transfer system may be employed, in which a toner image formed on the electrophotographic photoreceptor 7 is directly transferred to a recording medium.

Figure 6:
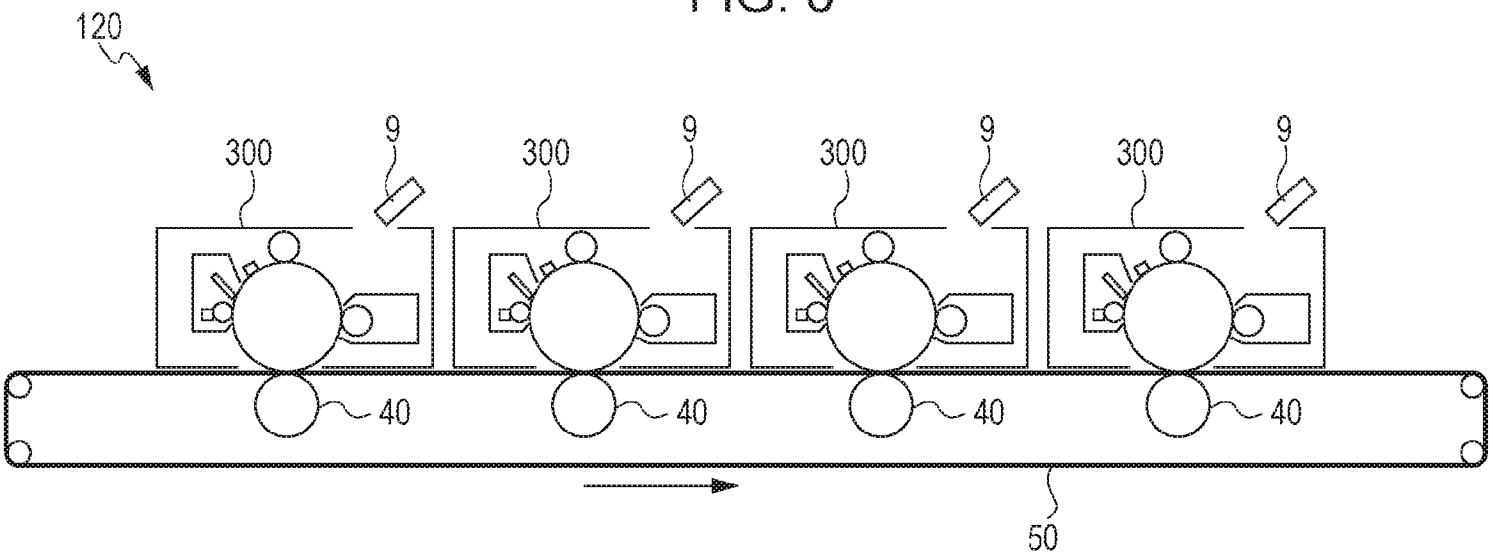
FIG. 6 schematically illustrates another example of the structure of the image forming apparatus according to a second exemplary embodiment.

FIG. 6 schematically illustrates another example of the structure of the image forming apparatus according to the second exemplary embodiment.

An image forming apparatus 120 illustrated in FIG. 6 is a tandem-type multicolor image forming apparatus including four process cartridges 300. In the image forming apparatus 120, the four process cartridges 300 are disposed in parallel so as to overlie the intermediate transfer body 50, and one electrophotographic photoreceptor serves for one color. Except that the image forming apparatus 120 is a tandem type, it has the same structure as the image forming apparatus 100.

EXAMPLES

Examples of the exemplary embodiments of the invention will now be described, but the exemplary embodiments of the invention are not limited thereto. In the following description, the terms "part" and "%" are on a weight basis unless otherwise specified.

Example 1

Formation of Undercoat Layer

With 500 parts by weight of tetrahydrofuran, 55 parts by weight of zinc oxide particles (manufactured by TAYCA CORPORATION, volume average primary particle size: 85 nm, specific surface area: 12 $m^2/g$) are mixed by stirring. KBM603 [manufactured by Shin-Etsu Chemical Co., Ltd., N-2-(aminoethyl)-3-aminopropyltrimethoxysilane] as a silane coupling agent (surface preparation agent) is added thereto in an amount of 0.80 parts by weight relative to 100 parts by weight of the zinc oxide particles, and the resulting mixture is stirred for 2 hours. Then, the tetrahydrofuran is removed by vacuum distillation, and the product is heated at 120° C. for 3 hours to obtain zinc oxide particles subjected to surface treatment with the silane coupling agent.

With 142 parts by weight of methyl ethyl ketone, 100 parts by weight of the zinc oxide particles subjected to surface treatment with the silane coupling agent, 1 part by weight of anthraquinone as an electron-accepting compound, 22.5 parts by weight of blocked isocyanate (Sumidur 3173, manufactured by Sumitomo Bayer Urethane Co., Ltd.) as a curing agent, and 25 parts by weight of a butyral resin (S-LEC BM-1, manufactured by SEKISUI CHEMICAL CO., LTD.) are mixed to produce a liquid mixture. Then, 38 pats by weight of this liquid mixture is mixed with 25 parts by weight of methyl ethyl ketone, and the mixture is subjected to dispersion for 5 hours (namely, dispersion of which the duration is 5 hours) in a sand mill with glass beads having a diameter of 1 mm to produce a dispersion liquid.

To the dispersion liquid, 0.008 parts by weight of dioctyltin dilaurate that serves as a catalyst and 6.5 parts by weight of silicone resin particles (Tospearl 145, manufactured by Momentive Performance Materials Inc.) are added to produce a coating liquid for forming an undercoat layer.

The coating liquid is applied to an aluminum substrate having a diameter of 30 mm by dip coating and then cured by drying at a curing temperature of 183° C. and a wind velocity of 1.1 m/s for a curing time of 24 minutes to form an undercoat layer having a thickness of 25 μm.

Formation of Charge-Generating Layer

A charge-generating material that is a mixture of 15 parts by weight of chlorogallium phthalocyanine crystal having diffraction peaks at Bragg angles (2θ±0.2°) of at least 7.4°, 16.6°, 25.5°, and 28.3° in an X-ray diffraction spectrum using CuKα characteristic X-rays, 10 parts by weight of a vinyl chloride-vinyl acetate copolymer resin (VMCH, manufactured by Union Carbide Corporation), and 300 parts by weight of n-butyl alcohol is subjected to dispersion for 4 hours in a sand mill with glass beads having a diameter of 1 mm to produce a coating liquid for forming a charge-generating layer. The coating liquid for forming a charge-generating layer is applied to the undercoat layer by dip coating and then dried at 150° C. for 5 minutes to form a charge-generating layer having a thickness of 0.2 μm.

Formation of Charge-Transporting Layer

Then, 8 parts by weight of tetrafluoroethylene resin particles (number average primary particle size: 0.2 μm), 0.015 parts by weight of an alkyl-fluoride-group-containing methacrylic copolymer (weight average molecular weight: 30000), 4 parts by weight of tetrahydrofuran, and 1 part by weight of toluene are mixed with each other by stirring for 48 hours at a solution temperature maintained to be 20° C., thereby obtaining a suspension A of the tetrafluoroethylene resin particles.

Then, 4 parts by weight of N,N'-diphenyl-N,N'-bis(3-methylphenyl)-[1,1']biphenyl-4,4'-diamine as a charge-transporting material, 6 parts by weight of a polycarbonate resin involving bisphenol Z (viscosity average molecular weight: 40,000), 0.1 part by weight of 2,6-di-t-butyl-4-methylphenol as an antioxidant are mixed with each other and then dissolved in a mixed solvent of 24 parts by weight of tetrahydrofuran and 11 parts by weight of toluene to obtain a mixed solution B.

The suspension A of the tetrafluoroethylene resin particles is added to the mixed solution B and mixed by stirring. Then, the mixture is repeatedly subjected to dispersion six times, in which pressure is increased to 500 $kgf/cm^2$, with a high-pressure homogenizer (manufactured by YOSHIDA KIKAI CO., LTD.) equipped with a penetrating chamber having a fine channel; and fluorine-modified silicone oil (trade name: FL-100, manufactured by Shin-Etsu Silicone) is added thereto in an amount adjusted to be 5 ppm. The resulting product is stirred to yield a coating liquid for forming a charge-transporting layer. The coating liquid is applied to the charge-generating layer so as to have a thickness of 24.0 μm and then dried at 150° C. for 25 minutes to form a charge-transporting layer, thereby producing a predetermined electrophotographic photoreceptor. Through such a process, a photoreceptor of Example 1 is obtained.

Example 2

In the formation of the undercoat layer, zinc oxide particles (manufactured by TAYCA CORPORATION, volume average primary particle size: 90 nm, specific surface area: 10 $m^2/g$) are used in place of the zinc oxide particles (manufactured by TAYCA CORPORATION, volume average primary particle size: 85 nm, specific surface area: 12 $m^2/g$), and the duration of the dispersion in the sand mill is changed to 4.5 hours. Except for these changes, a photoreceptor is produced as in Example 1.

Example 3

In the formation of the undercoat layer, zinc oxide particles (manufactured by TAYCA CORPORATION, volume average primary particle size: 60 nm, specific surface area: 15 $m^2/g$) are used in place of the zinc oxide particles (manufactured by TAYCA CORPORATION, volume average primary particle size: 85 nm, specific surface area: 12 $m^2/g$), and the duration of the dispersion in the sand mill is changed to 5.5 hours. Except for these changes, a photoreceptor is produced as in Example 1.

Examples 4 and 5

In the formation of the undercoat layer, the curing temperature is changed as shown in Table 1. Except for this change, photoreceptors are produced as in Example 1.

Comparative Example 1

In the formation of the undercoat layer, zinc oxide particles (manufactured by TAYCA CORPORATION, volume average primary particle size: 50 nm, specific surface area: 19 $m^2/g$) are used in place of the zinc oxide particles (manufactured by TAYCA CORPORATION, volume average primary particle size: 85 nm, specific surface area: 12 $m^2/g$). Except for this change, a photoreceptor is produced as in Example 1.

Comparative Example 2

In the formation of the undercoat layer, zinc oxide particles (manufactured by TAYCA CORPORATION, volume average primary particle size: 80 nm, specific surface area: 12 $m^2/g$) are used in place of the zinc oxide particles (manufactured by TAYCA CORPORATION, volume average primary particle size: 85 nm, specific surface area: 12 $m^2/g$), and the duration of the dispersion time in the sand mill is changed to 3 hours. Except for these changes, a photoreceptor is produced as in Example 1.

Measurement and Evaluation

Measurement of Current Value of Photoreceptor

A temporal change in the current value of a photoreceptor after the beginning of application of a square wave voltage is measured in the manner described above. The ratio of $T_2$ to $T_1$ ($T_2/T_1$) is determined, where $T_1$ is the time that takes for the current value to reach the maximum after the beginning of the application, and $T_2$ is the time that takes for the current value to reach the maximum after the beginning of the application and then decrease to one fifth of the maximum. Table 1 shows results of the measurement [$T_1$, $T_2$, and ratio ($T_2/T_1$)].

Evaluation of Fine Colored Lines

The photoreceptors of Examples and Comparative Examples are individually attached to DocuCentreV C2263 that has been modified to have a charging device of contact charging in which only the direct-current voltage is applied to a charging roll. Under environment of high temperature and high humidity (temperature of 28° C. and 85% relative humidity, 5000 sheets of A4 paper of which a half-tone image has been formed on the entire surface at an image density of 30% are output, and then a sheet of A4 paper of which a half-tone image has been formed on the entire surface at an image density of 30% is output. On the finally output image, a region positioned at the upper left and having a length of 94 mm and width of 200 mm is visually observed and classified as follows. The degrees from G0 to G2 are acceptable. Table 1 shows results of the evaluation.

G0: No fine colored lines observed
G1: From 1 to 3 fine colored lines observed
G2: From 4 to 10 fine colored lines observed
G3: From 11 to 20 fine colored lines observed
G4: 21 or more fine colored lines observed

TABLE 1

| | Metal oxide | Particle size of metal oxide (nm) | Specific surface area of metal oxide ($m^2/g$) | Duration of dispersion (hr) | Curing temperature (° C.) | Curing time (min) | $T_1$ (μs) | $T_2$ (μs) | Ratio ($T_2/T_1$) | Evaluation of fine colored lines | Other problems |
|---|---|---|---|---|---|---|---|---|---|---|---|
| Example 1 | Zinc Oxide | 85 | 12 | 5 | 183 | 24 | 0.030 | 0.267 | 8.9 | G1 | None |
| Example 2 | Zinc Oxide | 90 | 10 | 4.5 | 183 | 24 | 0.028 | 0.294 | 10.5 | G0 | None |
| Example 3 | Zinc Oxide | 60 | 15 | 5.5 | 183 | 24 | 0.030 | 0.105 | 3.5 | G2 | None |
| Example 4 | Zinc Oxide | 85 | 12 | 5 | 170 | 24 | 0.032 | 0.240 | 7.5 | G1 | None |
| Example 5 | Zinc Oxide | 85 | 12 | 5 | 190 | 24 | 0.030 | 0.099 | 3.3 | G2 | None |
| Comparative Example 1 | Zinc Oxide | 50 | 19 | 5 | 183 | 24 | 0.032 | 0.064 | 2.0 | G4 | None |

TABLE 1-continued

| | Metal oxide | Particle size of metal oxide (nm) | Specific surface area of metal oxide ($m^2/g$) | Duration of dispersion (hr) | Curing temperature (° C.) | Curing time (min) | $T_1$ (μs) | $T_2$ (μs) | Ratio ($T_2/T_1$) | Evaluation of fine colored lines | Other problems |
|---|---|---|---|---|---|---|---|---|---|---|---|
| Comparative Example 1 | Zinc Oxide | 80 | 12 | 3 | 183 | 24 | 0.034 | 0.544 | 16.0 | Evaluation incapable for high concentration | Increased con-centration |

These results show that the occurrence of fine colored lines is reduced in Examples as compared with Comparative Example 1 in which the ratio ($T_2/T_1$) is less than 3.2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a photosensitive layer disposed on the conductive substrate, wherein when time that takes for a current value to reach the maximum after beginning of application of a square wave voltage to the electrophotographic photoreceptor is $T_1$ and time that takes for the current value to reach the maximum after the beginning of the application of the square wave voltage and then decrease to one fifth of the maximum is $T_2$, $T_2$ is approximately from 3.2 to 11.0 times as large as $T_1$.

2. The electrophotographic photoreceptor according to claim 1, wherein $T_2$ is approximately from 5.0 to 10.8 times as large as $T_1$.

3. The electrophotographic photoreceptor according to claim 1, wherein $T_2$ is approximately from 9.0 to 10.5 times as large as $T_1$.

4. The electrophotographic photoreceptor according to claim 1, wherein $T_1$ is approximately from 0.01 μs to 0.05 μs.

5. The electrophotographic photoreceptor according to claim 1, wherein $T_2$ is approximately from 0.10 μs to 0.50 μs.

6. The electrophotographic photoreceptor according to claim 1, wherein the photosensitive layer includes a charge-generating layer and a charge-transporting layer, and an undercoat layer is further provided between the conductive substrate and the photosensitive layer.

7. The electrophotographic photoreceptor according to claim 6, wherein the undercoat layer contains zinc oxide particles having a volume average primary particle size ranging approximately from 60 nm to 200 nm.

8. The electrophotographic photoreceptor according to claim 6, wherein the undercoat layer contains zinc oxide particles having a specific surface area ranging approximately from 10 $m^2/g$ to 15 $m^2/g$.

9. The electrophotographic photoreceptor according to claim 6, wherein the undercoat layer contains zinc oxide particles having a volume average primary particle size ranging approximately from 80 nm to 95 nm and a specific surface area ranging approximately from 10 $m^2/g$ to 15 $m^2/g$.

10. The electrophotographic photoreceptor according to claim 1, wherein the photosensitive layer has a thickness of approximately 20 μm or more.

11. A process cartridge comprising the electrophotographic photoreceptor according to claim 1, wherein the process cartridge is removably attached to an image forming apparatus.

12. An image forming apparatus comprising:

the electrophotographic photoreceptor according to claim 1;

a charging unit that has a charging member which contacts the electrophotographic photoreceptor and that serves to apply only the direct-current voltage to the charging member to charge the surface of the electrophotographic photoreceptor;

an electrostatic latent image forming unit that serves to form an electrostatic latent image on the charged surface of the electrophotographic photoreceptor;

a developing unit that serves to develop the electrostatic latent image on the surface of the electrophotographic photoreceptor with a developer containing toner to form a toner image; and a transfer unit that serves to transfer the toner image to the surface of a recording medium.

13. The image forming apparatus according claim 12, wherein the apparatus is free from an erasing unit that serves for removal of residual charges on the surface of the electrophotographic photoreceptor.

* * * * *